US011002101B2

(12) United States Patent
Golinowski et al.

(10) Patent No.: US 11,002,101 B2
(45) Date of Patent: May 11, 2021

(54) FRAC BALL DROPPER

(71) Applicant: 1106666 B.C. LTD., Edmonton (CA)

(72) Inventors: Jeff Golinowski, Edmonton (CA); Cody Brown, Edmonton (CA); Layne Holmwood, Edmonton (CA)

( * ) Notice: Subject to any disclaimer, the term of this patent is extended or adjusted under 35 U.S.C. 154(b) by 151 days.

(21) Appl. No.: 16/103,738

(22) Filed: Aug. 14, 2018

(65) Prior Publication Data

US 2020/0056440 A1 Feb. 20, 2020

(51) Int. Cl.
*E21B 33/068* (2006.01)
*E21B 43/26* (2006.01)

(52) U.S. Cl.
CPC ..... *E21B 33/068* (2013.01); *E21B 43/26* (2013.01)

(58) Field of Classification Search
CPC ..... E21B 33/068
See application file for complete search history.

(56) References Cited

U.S. PATENT DOCUMENTS

| | | | | |
|---|---|---|---|---|
| 3,039,531 | A * | 6/1962 | Scott | E21B 33/068 166/70 |
| 3,218,659 | A * | 11/1965 | Rowley | F16L 55/46 15/104.061 |
| 4,491,177 | A | 1/1985 | Baugh | |
| 5,758,726 | A | 6/1998 | Streich et al. | |
| 6,302,199 | B1 | 10/2001 | Hawkins et al. | |
| 6,776,228 | B2 | 8/2004 | Pedersen et al. | |
| 7,281,589 | B2 | 10/2007 | Robichaux et al. | |
| 7,571,773 | B1 | 8/2009 | West et al. | |
| 8,136,585 | B2 | 3/2012 | Cherewyk | |
| 8,636,055 | B2 | 1/2014 | Young et al. | |
| 9,103,183 | B2 | 8/2015 | He et al. | |
| 9,109,422 | B2 | 8/2015 | Ferguson et al. | |
| 9,115,562 | B2 | 8/2015 | Guidry et al. | |
| 9,228,417 | B2 | 1/2016 | McGuire et al. | |
| 9,260,933 | B2 | 2/2016 | Artherholt et al. | |

(Continued)

FOREIGN PATENT DOCUMENTS

| | | | |
|---|---|---|---|
| CA | 2801677 | 1/2013 | |
| WO | 2015081092 | 6/2015 | |
| WO | WO-2018094220 A1 * | 5/2018 | E21B 33/068 |

OTHER PUBLICATIONS

Frac Launch—Engineering Slide Deck—Jan. 2018.

(Continued)

*Primary Examiner* — Blake E Michener
(74) *Attorney, Agent, or Firm* — Bennett Jones LLP

(57) ABSTRACT

An apparatus and method are provided for dropping a frac ball, in which a rotating member defines a recess for receiving a single frac ball, and rotates in relation to a stationary member, which may be attached to a wellhead tubular. When the rotating member is rotated into a loading orientation, the recess receives a single frac ball. The frac ball may be gravity fed towards the recess. When the rotating member is rotated into a releasing orientation, the recess is oriented to allow the single one of the frac balls to drop out of the recess. A hydraulic gear and rack assembly actuates rotation of the rotating member. An inlet tube holds multiple frac balls and guides them sequentially, one at a time, into the recess. An outlet tube guides frac balls from the recess towards a desired location, such as an entry guide surrounding the wellhead tubular.

25 Claims, 7 Drawing Sheets

(56) References Cited

U.S. PATENT DOCUMENTS

| | | | | |
|---|---|---|---|---|
| 9,644,443 | B1 | 5/2017 | Johansen et al. | |
| 9,879,499 | B2 | 1/2018 | Artherholt et al. | |
| 2010/0288496 | A1* | 11/2010 | Cherewyk | E21B 33/068 166/284 |
| 2016/0290087 | A1 | 10/2016 | Cherewyk et al. | |
| 2017/0022777 | A1* | 1/2017 | Allen | E21B 34/02 |
| 2017/0051572 | A1 | 2/2017 | Penney et al. | |
| 2018/0002999 | A1 | 1/2018 | Johnson | |
| 2019/0301261 | A1* | 10/2019 | Anthony | E21B 33/068 |
| 2019/0360296 | A1* | 11/2019 | Pedraza | E21B 33/068 |

OTHER PUBLICATIONS

Left Right Assembly slide.
Frac Launch Equipment Standard Operating Instruction.
Maximizing Total Available Pumping Time with Innovative Wireline Completion Technologies, <http://grenergyservices.com/tech-briefs/70-maximizing-pumping-time>.

* cited by examiner

FRAC BALL DROPPER

FIELD OF THE INVENTION

The present invention relates to systems, apparatuses, and methods for dropping frac balls into a wellhead tubular.

BACKGROUND OF THE INVENTION

Hydraulic fracturing operations for stimulating oil and gas producing geological formations may involve conveying small spherical bodies, referred to as "frac balls", in treatment fluid into a downhole tubular string. The frac balls may engage seats defined by frac plugs in the tubular string to isolate target zones of the formation.

Apparatuses known variously as frac ball droppers, launchers, or injectors are used to release frac balls into wellhead tubulars, so that they can flow into the downhole tubular string. It is important that frac balls be released into the wellhead tubular only when intended. Accordingly, there is a need for apparatuses that reduce the risk of unintentional release of frac balls, and allow for confirmation of the release of frac balls.

SUMMARY OF THE INVENTION

In one aspect, the present invention comprises an apparatus for dropping frac balls into a wellhead tubular. The apparatus comprises a stationary member and a rotating member. The rotating member defines a recess shaped and sized to receive a single one of the frac balls. The rotating member is rotatably attached to the stationary member to rotate between a loading orientation in which the recess receives the single one of the frac balls, and a releasing orientation in which the recess is oriented to allow the single one of the frac balls to drop out of the recess.

In one embodiment of the apparatus, in the loading orientation, the recess is oriented to allow one of the frac balls to drop into the recess by gravity feed.

In one embodiment of the apparatus, the apparatus further comprises a means for rotating the rotating member between the loading orientation and the releasing orientation. The means for rotating the rotating member may comprise a toothed rack in driving engagement with a toothed gear defined by the rotating member. The means for rotating the rotating member may further comprise a hydraulic cylinder comprising a piston rod attached to the toothed gear, and a hydraulic pump for actuating the piston rod. In other embodiments, the means for rotating the rotating member may comprise a motor, a winch, or a rotary actuator driven by mechanical, electrical, hydraulic, pneumatic or vacuum power.

In one embodiment of the apparatus, the means for rotating the rotating member is controllable by an operator located remotely from the rotating member.

In one embodiment of the apparatus, the stationary member is adapted for attachment to a pipe, such as a lubricator, that is attachable to the wellhead tubular to form a continuous tubular path. In one embodiment of the apparatus, the stationary member is attached or attachable to a support member, such as a rack, attached or attachable to the wellhead tubular.

In one embodiment of the apparatus, the stationary member may comprise a housing defining a frac ball inlet, and a frac ball outlet. The rotating member is disposed within the housing. When the rotating member is in the loading orientation, the recess is aligned with the frac ball inlet to allow the single one of the frac balls to pass through the frac ball inlet and into the recess. When the rotating member is in the releasing orientation, the recess is aligned with the frac ball outlet to allow the single one of the frac balls to drop out of the recess and through the frac ball outlet. The housing may define an internal race that guides the single one of the frac balls from the frac ball inlet to the frac ball outlet, when the frac ball is received in the recess of the rotating member as the rotating member rotates between the loading orientation and the releasing orientation.

In one embodiment of the apparatus, the apparatus further comprises an inlet tube for holding the frac balls and directing the frac balls to pass, one at a time, into the recess when the rotating member is in the loading orientation. The inlet tube may be transparent or translucent.

In one embodiment of the apparatus, the apparatus further comprises an outlet tube for directing the single one of the frac balls that drops out of the recess to a desired location, such as an entry guide circumferentially surrounding the wellhead tubular. The outlet tube may be transparent or translucent.

In another aspect, the present invention comprises a method of dropping frac balls into a wellhead tubular. The method comprises the steps of:

(a) providing an apparatus comprising a stationary member, and a rotating member defining a recess shaped and sized to receive a single one of the frac balls, wherein the rotating member is rotatably attached to the stationary member; and (b) rotating the rotating member, in relation to the stationary member, from a loading orientation and a releasing orientation, wherein:

(i) in the loading orientation, the recess receives the single one of the frac balls; and (ii) in the releasing orientation, the recess is oriented to drop the single one of the frac balls to drop out of the recess.

In one embodiment of the method, in the loading orientation, the recess is oriented to allow the single one of the frac balls to drop into the recess by gravity feed.

In one embodiment of the method, the step of rotating the rotating member comprises moving a toothed rack in driving engagement with a toothed gear defined by the rotating member. The step of moving the toothed rack may comprise using a hydraulic pump to actuate a piston rod of a hydraulic cylinder attached to the toothed rack.

In one embodiment of the method, rotating the rotating member comprises using a motor, a winch, or a rotary actuator driven by mechanical, electrical, hydraulic, pneumatic or vacuum power.

In one embodiment of the method, the step of rotating the rotating member comprises controlling a means for rotating the rotating member from a location located remotely from the rotating member.

In one embodiment of the method, the method further comprises the step of attaching the stationary member to a pipe, such as a lubricator, that is attachable to the wellhead tubular, to form a continuous tubular path, wherein the rotating member is rotatably attached to the stationary member. In one embodiment of the method, the stationary member is attached to a support member attached to the wellhead tubular.

In one embodiment of the method, the rotating member is rotatably disposed in a housing defined by the stationary member, wherein the housing defines a frac ball inlet, and a frac ball outlet. In the loading orientation, the recess is aligned with the frac ball inlet to allow the single one of the frac balls to drop through the frac ball inlet and into the recess. In the releasing orientation, the recess is aligned with the frac ball outlet to allow the single one of the frac balls to drop out of the recess and through the frac ball outlet. The housing may define an internal race that guides the single one of the frac balls from the frac ball inlet to the frac ball outlet, when the frac ball is received in the recess of the rotating member as the rotating member rotates between the loading orientation and the releasing orientation.

In one embodiment of the method, the method further comprises loading the frac balls into an inlet tube, wherein the single one of the frac balls drops from the inlet tube into the recess when the rotating member is in the loading orientation. The inlet tube may be transparent or translucent.

In one embodiment of the method, the method further comprises the step of allowing the frac ball dropped by the recess when the rotating member is in the releasing orientation to be drop into an outlet tube. The outlet tube, which may be transparent or translucent, may guide the frac ball toward an entry guide circumferentially extending upwardly and radiating horizontally outwardly from an upper end of the wellhead tubular.

In another aspect, the present invention comprises a system for dropping a frac ball into a wellhead assembly comprising a wellhead tubular, and an entry guide extending upwardly and radiating horizontally outward from an upper end of the wellhead tubular. The system comprises a pipe having a lower end attachable to the upper end of the wellhead tubular to form a continuous tubular path, an apparatus for dropping the frac ball into the entry guide, and a crane for lifting the lower end of the pipe out of engagement with the upper end of the wellhead tubular, to allow the frac ball to drop through the entry guide and into the wellhead tubular. In an embodiment of the system, the apparatus for dropping the frac ball may be attached to the pipe. In an embodiment of the system, the pipe may comprise a lubricator for inserting a tool into the wellhead tubular. In an embodiment of the system, the apparatus for dropping the frac ball may be an apparatus or any of the embodiments thereof, as described above.

In another aspect, the present invention comprises a method of dropping a frac ball into a wellhead assembly comprising a wellhead tubular, and an entry guide extending upwardly and radiating horizontally outward from an upper end of the wellhead tubular. The method comprises the steps of:

(a) attaching a lower end of a pipe to an upper end of the wellhead tubular such that the pipe and the wellhead tubular form a continuous tubular path;
(b) using an apparatus for dropping the frac ball to drop the frac ball into the entry guide, while the lower end of the pipe is attached to the upper end of the wellhead tubular; and
(c) detaching the lower end of the pipe from the upper end of the wellhead tubular and lifting the lower end of the pipe out of engagement with the wellhead tubular, whereupon the frac ball drops through the entry guide into wellhead tubular.

In an embodiment of the method, the apparatus for dropping the frac ball may be attached to the pipe. In an embodiment of the method, the method further comprises, after step (a) and before step (b), the step of inserting the tool into the wellhead tubular. In an embodiment of the method, the apparatus for dropping the frac ball may be an apparatus or any of the embodiments thereof, as described above.

BRIEF DESCRIPTION OF THE DRAWINGS

In the drawings shown in the specification, like elements may be assigned like reference numerals. The drawings are not necessarily to scale, with the emphasis instead placed upon the principles of the present invention. Additionally, each of the embodiments depicted are but one of a number of possible arrangements utilizing the fundamental concepts of the present invention.

DETAILED DESCRIPTION OF EMBODIMENTS OF THE INVENTION

Figure 1:
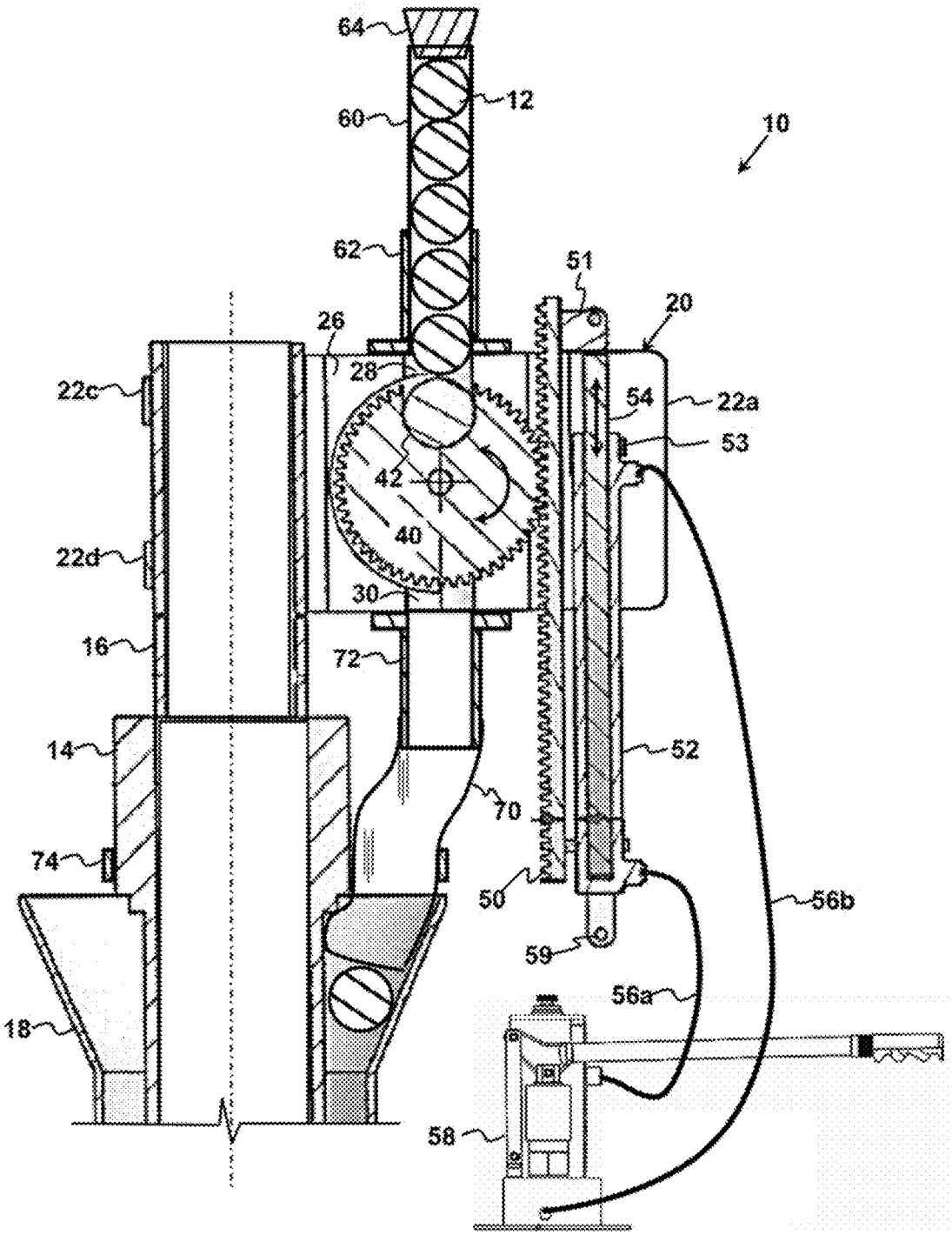
FIG. 1 shows a front, medial, cross-sectional view of an embodiment of an apparatus of the present invention, for dropping frac balls, in relation to part of a wellhead pressure control assembly.

Apparatus.

FIGS. 1 to 4 show an embodiment of an apparatus (10) of the present invention, for dropping frac balls (12), into a wellhead assembly (not shown). In this exemplary use, the apparatus (10) is used with a pipe in the form of a test pin sub (14) and an attached lubricator (16). The test pin sub (14) communicates with the wellhead assembly such as a tubular adapter extending upwardly from a Christmas tree. A conical shape entry guide (18) is attached to the upper end of the wellhead assembly, radiates outwardly from the tubular adapter, and circumferentially surrounds the lower end of the test pin sub (14) when the test pin sub (14) is coupled to the tubular adapter of the wellhead assembly. The apparatus (10) drops one of the frac balls (12) into the entry guide (18). When the test pin sub (14) is detached from the tubular adapter and lifted upwards, that allows one of the frac balls (12) to drop through the entry guide (18), and into the wellhead assembly.

In the embodiment shown in FIG. 1, the apparatus (10) includes a stationary member (20), a rotating member (40), an inlet tube (60), an outlet tube (70), a means for rotating the rotating member (40), and other parts which are described in greater detail below. Preferably, the stationary member (20), and the rotating member (40), are made of relatively light weight materials, such as aluminum or a durable plastic, so that the stationary member (20) does not interfere with the manipulation of the lubricator (16). For example, in one embodiment, the entire apparatus (10) may have a weight less than about 160 pounds (about 73 kilograms).

The apparatus (10) of the present invention is not limited to a particular configuration of wellhead assembly, and may be adapted for use with wellhead assemblies having different configurations. For example, the apparatus (10) may be used to drop a frac ball (12) directly into a wellhead tubular of a wellhead assembly, without the presence of any entry guide (18), as will be described below in respect to an alternative embodiment of the apparatus (10) shown in FIG. 6.

Stationary Member.

The stationary member (20) provides a structure to which the rotating member (40) is rotatably attached.

In the embodiment shown in FIGS. 1 to 4, the stationary member (20) is adapted for removable attachment to a wellhead tubular, such as the lubricator (16). The stationary member (20) is formed by four parts (22*a*, 22*b*, 22*c*, 22*d*), each having arcuate surfaces that match the external surface of the lubricator (16). A series of bolts (24) join the members together so that their arcuate surfaces grip the lubricator (16) and hold the apparatus (10) in fixed relationship to the lubricator (16). In other embodiments, the stationary member (20) may be attached to the wellhead tubular in other ways, using other types of fasteners.

Figure 6:
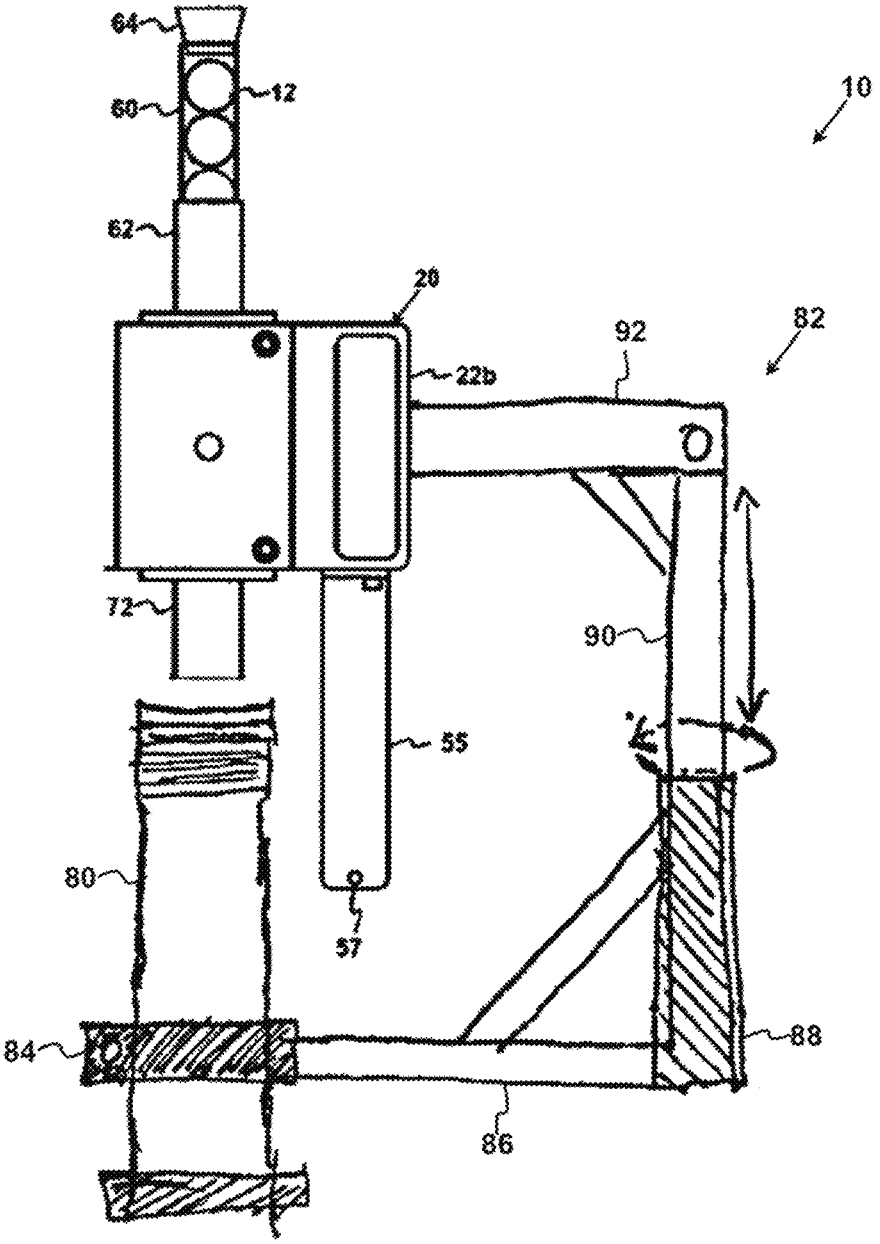
FIG. 6 shows a front view of a second embodiment of the apparatus of the present invention, for dropping frac balls into a wellhead tubular, where the apparatus is attached by a support member to a wellhead tubular.

In still other embodiments, the stationary member (20) may not be attached to the lubricator (16). For instance, the stationary member (20) may be supported in the appropriate position by a different structure associated with the wellhead assembly, or may be supported by a structure specifically dedicated to that purpose. For example, FIG. 6 shows an alternative embodiment of the apparatus (10) that is the similar to the embodiment shown in FIGS. 1 to 4, with analogous parts labelled with the same reference numbers. In this embodiment, the stationary member (20) is formed by only two parts (22*a*, 22*b*). The apparatus (10) is attached to a wellhead tubular (80) by a support member in the form of a wellhead mount (82). The wellhead mount (82) includes a clamp (84) that secures the wellhead mount (82) to the wellhead tubular (80), a lower beam (86) that cantilevers horizontally away from the clamp (84), a post (88, 90) that extends upwardly from the lower beam (86), and an upper beam (92) that cantilevers horizontally from the vertical post (88, 90) and supports the stationary member (20) above the wellhead tubular (80). The post (88, 90) includes a lower section (88) and a height adjustable upper section (90) (e.g., by telescoping arrangement, or by threaded connection), for adjusting the vertical position of the stationary member (20) in relation to the wellhead tubular (80).

Figure 5:
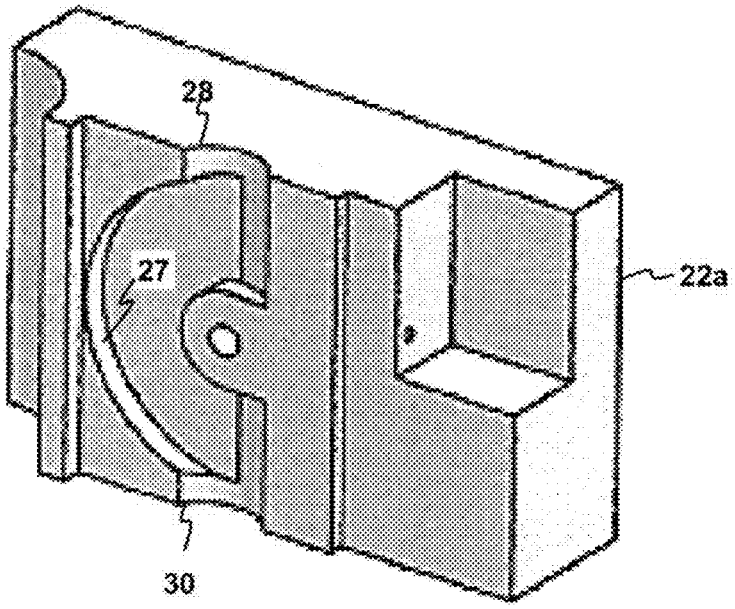
FIG. 5 shows a perspective view of a part of a stationary member in another embodiment of an apparatus of the present invention.

In the embodiment shown in the Figures, the stationary member (20) also provides a housing (26) for the rotating member (40). The housing (26) may help the recess (42) of the rotating member (40) to retain the frac ball (12) as it moves from the loading orientation to the releasing orientation. In this embodiment, the opposing surfaces of the parts (22*a*, 22*b*) collectively define a horizontally oriented, substantially cylindrically-shaped internal cavity that receives the rotating member (40). The opposing surfaces also define a semi-circular internal race that guides rolling movement of one of the frac balls (12) by the rotating member (40) within the housing (26). FIG. 5 shows another embodiment of part (22*a*) of the stationary member (20) defining one half of a semi-circular internal race (27). The embodiment of parts (22*a*, 22*b*) shown in FIG. 1 similarly defines an internal race, which is concealed from view in FIG. 1. Referring back to FIG. 1, the upper end of the parts (22*a*, 22*b*) collectively define a frac ball inlet (28) that allows a frac ball (12) to drop into the housing (26) towards the rotating member (40). In other embodiments, the frac ball inlet (28) may be positioned to allow the frac ball (12) to pass towards the recess (42) of the rotating member (40) in the loading position, without dropping towards the rotating member (40). As shown in FIG. 1, the lower end of the parts (22*a*, 22*b*) collectively define a frac ball outlet (30) that allows a frac ball (12) to drop out of the housing (26).

Rotating Member.

The rotating member (40) is a part that defines a recess (42) that is shaped and sized to receive a single one of the frac balls (12). The rotating member (40) is rotatably attached to the stationary member (20) to rotate between a loading orientation in which the recess (42) receives the single one of the frac balls (12), and a releasing orientation in which the recess (42) is oriented to allow the single one of the frac balls (12) to drop out of the recess.

In the embodiment shown in the Figures, the rotating member (40) is substantially disc shaped, except that a portion of the edge of the rotating member (40) is concavely contoured to define the recess (42) for receiving one of the frac balls (12). As a non-limiting example, if the apparatus (10) is used with a frac ball (12) having a diameter of about 1.75 inches (about 44 mm), the recess (42) may be sized to be larger within a tolerance of about $1/10^{th}$ of an tenth (about 2.5 mm), so that only one frac ball (12) can pass into the recess (42). In other embodiments, the rotating member (40) and its recess (42) may have different shapes so long as the recess (42) is shaped and size to receive only a single frac ball (12). For example, the rotating member (40) may be spherical in shape, and the recess (42) may be a depression defined by a spherically concave surface. As another example, the rotating member (40) may be shaped like a wheel having hub with radiating spokes, with the recess (42) being defined by the space between adjacent spokes.

In embodiments, the apparatus (10) may be provided with a set of interchangeable rotating members (40), each of which has a recess (42) sized to receive frac balls (12) with a different range of diameters, as may be used in fracturing operations. As non-limiting examples, the apparatus (10) may be provided with first, second, and third rotating members (40) having a recess (42) sized to receive frac balls (12) with diameters in a small diameter range of about 1.250 inches to 1.500 inches (about 31.75 mm to 38.10 mm), a medium diameter range of about 1.750 inches to 2.000 inches (about 44.45 mm to 50.80 mm), and a large diameter range of about 2.125 inches to 2.500 inches (about 53.985 mm to 63.50 mm), respectively. In the embodiment shown in the Figures, the parts (22*a*, 22*b*) of the stationary member (20) may be readily disassembled by unscrewing of bolts (24) to allow for substitution of rotating members (40) having different sized recesses (42).

In this embodiment, the rotating member (40) rotates in relation to the stationary member (20) about a horizontally-oriented axle. In this embodiment, when the rotating member (40) is in the loading orientation as shown in FIG. 1, the recess (42) is oriented upwardly at the 12 o'clock position, and aligned with the frac ball inlet (28) to allow the single one of the frac balls (12) to drop through the frac ball inlet (28) into the recess (42), so that the frac balls (12) may be gravity fed into the recess (42), without the need for an actuator. In other embodiments, the orientation and position of the recess (42) when the rotating member (40) is in the loading position may differ from that described above, so long as the recess (42) is oriented to allow one of the frac balls to drop into the recess (42) under the influence of gravity. For example, the recess (42) may be oriented between the 9 o'clock and 12 o'clock positions, as viewed from the perspective of FIG. 1. In other embodiments, the frac balls (12) may not be gravity fed into the recess (42), and accordingly, the recess (42) may be in a variety of orientations to receive the frac ball (12) when the rotating member (40) is in the loading orientation. For example, the frac balls (12) may be placed manually into the recess (42), or a mechanical actuator may be provided to load one of the frac balls (12) into the recess (42).

In this embodiment, when the rotating member (40) is in the releasing orientation, the recess (42) is oriented downwardly at the 6 o'clock position, and aligned with the frac ball outlet (30) to allow the single one of the frac balls (12) to drop out of the recess (42) and through the frac ball outlet (30). In other embodiments, the orientation and position of the recess (42) when the rotating member (40) is in the loading position may differ from that described above, so long as the recess (42) is oriented to allow one of the frac balls to drop out of the recess (42) under the influence of gravity. For example, the recess (42) may be oriented between the 9 o'clock and 6 o'clock positions, when viewed from the perspective of FIG. 1. It will be appreciated that the orientation of the recess (42) required to drop the frac ball (12) may be affected by the shape of the recess (42).

Means for Rotating the Rotating Member.

The means for rotating the rotating member (40) may comprise a variety of suitable devices that may be used to rotate the rotatable member in relation to the stationary member (20).

Figure 2:
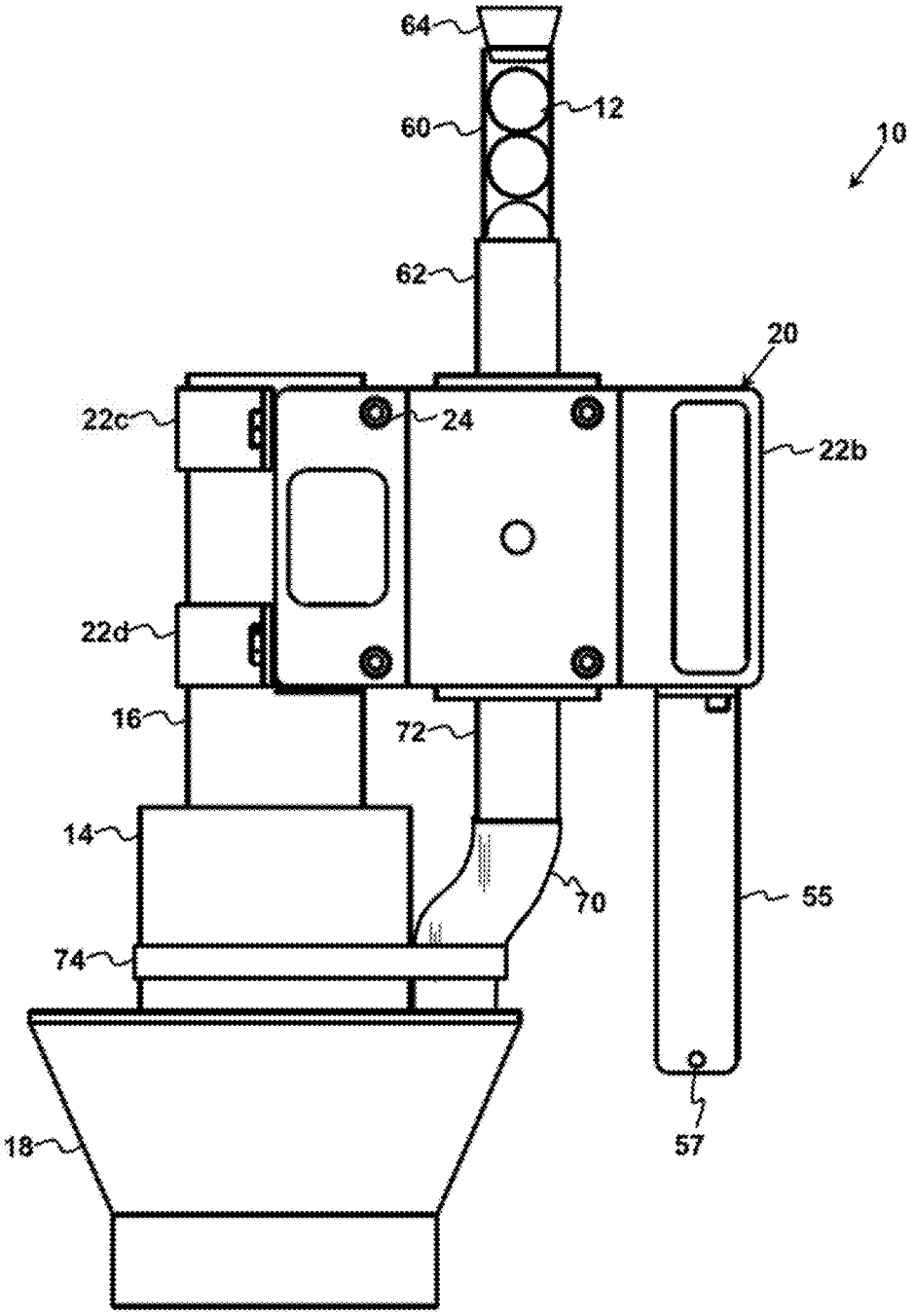
FIG. 2 shows a front view of the apparatus of FIG. 1, without the toothed rack, the hydraulic cylinder, and the hydraulic pump.
Figure 3:
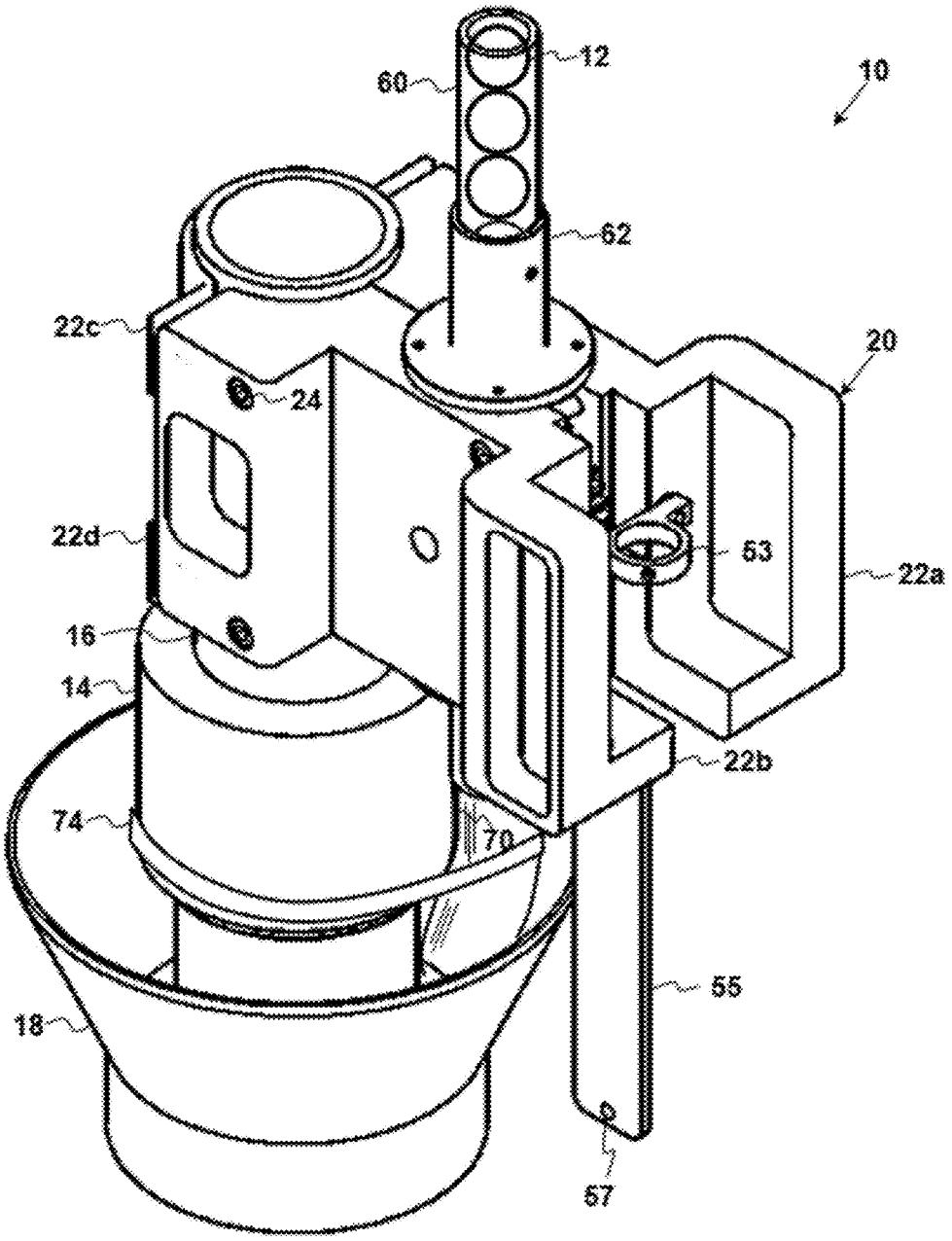
FIG. 3 shows a perspective view of the apparatus of FIG. 1, without the toothed rack, the hydraulic cylinder, and the hydraulic pump.
Figure 4:
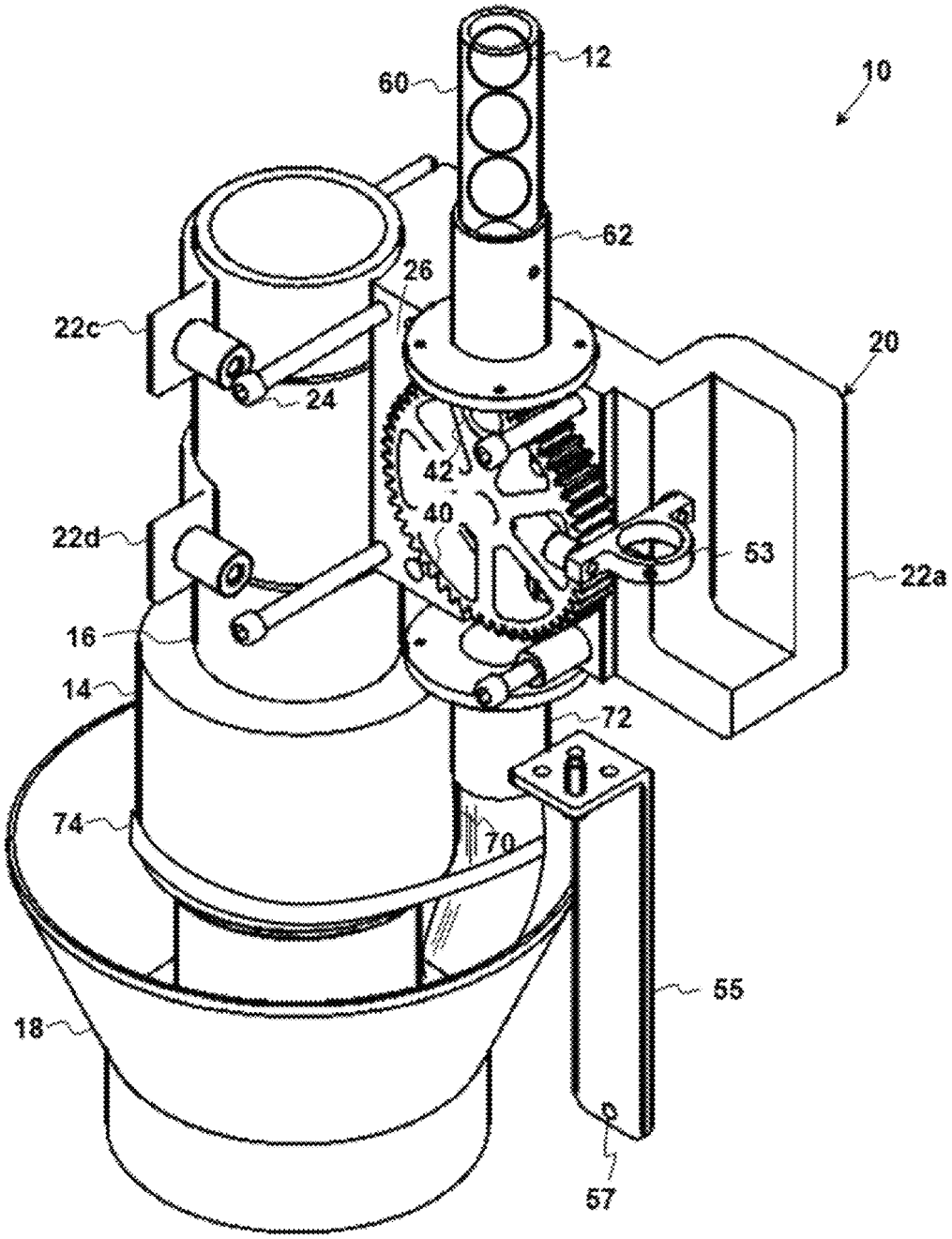
FIG. 4 shows a perspective view of the apparatus of FIG. 1, without the toothed rack, the hydraulic cylinder, and the hydraulic pump, and with part of the stationary member detached to show the internal components of the apparatus.

In the embodiment shown in FIGS. 1 to 4, the means for rotating the rotating member (40) include a toothed gear defined by the rotating member (40), a toothed rack (50), a hydraulic cylinder (52) with a moveable piston rod (54), and a hydraulic pump (58). In this embodiment, the hydraulic cylinder (52) is secured to the parts (22*a*, 22*b*) of the stationary member (20) by a retaining ring (53), and a pair of mounting brackets (55) (as shown in FIGS. 2 to 4). (Although only one mounting bracket (55) is shown in the Figures, a pair of mounting brackets (55) may be provided, with one mounting bracket (55) attached to part (22*a*) and positioned in front of the hydraulic cylinder (52), and the other mounting bracket attached to part (22*b*) and positioned behind the hydraulic cylinder (52).) To couple the hydraulic cylinder (52) to the mounting bracket (55), a locking pin is inserted through the pair of apertures (57) defined by the mounting bracket (55) and the aligned pair of apertures (59) defined by the bottom end cap of the hydraulic cylinder (52). Another locking pin is similarly used to couple the upper end of the piston rod (54) to a mounting bracket (51) attached to the upper end of the toothed rack (50) (as shown in FIG. 1).

In this embodiment, the hydraulic pump (58) is connected by hydraulic fluid lines (56*a*, 56*b*) to a pair of ports defined by the hydraulic cylinder (52). Preferably, the hydraulic fluid lines (56*a*, 56*b*) are sufficiently long so that the hydraulic pump (58) and an operator using the hydraulic pump (58) may be located on the ground at a safe distance away from the operations as described below. The hydraulic pump (58) has a valve switchable by an operator between a "releasing mode" and a "loading mode". In the "releasing mode", the hydraulic pump (58) creates a net upward fluid pressure acting on the piston rod (54) to cause the piston rod (54) to travel upwards (extend) within the hydraulic cylinder (52). In the "loading mode", the hydraulic pump (58) creates a net downward fluid pressure acting on the piston rod (54) to cause the piston rod (54) to travel downwards (retract) within the hydraulic cylinder (52). The hydraulic pump (58) may be manually operable by a hand lever. The piston rod (54) is attached to the toothed rack (50) so that the toothed rack (50) travels vertically in unison with the piston rod (54). The toothed rack (50) is in driving engagement with the toothed gear defined by the rotating member (40). Referring to FIG. 1, when the rotating member (40) is in the loading orientation, operation of the hydraulic pump (58) in the "releasing mode" drives upwards movement of the piston rod (54) and the attached toothed rack (50), which in turn drives counter-clockwise rotation (from the perspective of FIG. 1) of the rotating member (40) to the releasing orientation. Conversely, when the toothed rack (50) is in the releasing orientation, operation of the hydraulic pump (58) in the "loading mode" drives downward movement of the piston rod (54) and the attached toothed rack (50), which in turn drives clockwise rotation (from the perspective of FIG. 1) of the rotating member (40) to return to the loading orientation. In one embodiment, the hydraulic cylinder (52) may be configured so that the limits of travel of the piston rod (54) within the hydraulic cylinder (52) correspond to the loading orientation and the releasing orientation of the rotating member (40). In this embodiment, the rotating member (40) rotates through an angular distance of 180 degrees between the loading orientation and the releasing orientation, since the rotating member (40) rotates in a first direction when rotating from the loading orientation to the releasing orientation, and in an opposite second direction when rotating from the releasing orientation to the loading orientation. In other embodiments, the angular distance between the loading orientation and the releasing orientation may be less than or greater than 180 degrees. In other embodiments, the rotating member (40) may rotate 360 degrees, in a single direction, in one cycle from the loading orientation to the releasing orientation, and back to the loading orientation.

In comparison with some other types of means for rotating the rotating member, the manually operated hydraulic system as described above may have certain advantages. First, it avoids the need for an external power source. Second, it avoids the need for powered equipment (e.g., an electrical motor), which could pose spark hazards in the vicinity of the wellhead. Third, the position of the piston rod (54) may provide a visual indicator, of the angular position of the rotating member (40) even though the rotating member (40) may be concealed from view within the housing (26). Fourth, the limited travel of the piston rod (54) in the hydraulic cylinder (52) in combination with a manually operated hydraulic pump (58) may provide an operator with tactile feedback of when the rotating member (40) has reached the loading orientation or the releasing orientation. Fifth, the hydraulic pump (58) may be configured so that a pre-determined number of manual strokes (preferably more than one) of its hand lever are required to fully rotate the rotating member (40) from the loading orientation to the releasing orientation. In use, the counted number of strokes may serve as a proxy for the angular position of the rotating member (40). The latter three aspects may also help to reduce the risk of unintentional release of the frac ball (12), and to confirm that the frac ball (12) has been released when intended.

In other embodiments, the means for rotating the rotating member may comprise any mechanical device that allows an operator to deliberately and controllably rotate the rotating member (40) between the loading orientation and the releasing orientation, so as to deliberately load and release the single frac ball (12). In embodiments, the means for rotating the rotating member (40) may be actuated mechanically, electro-mechanically, hydraulically, pneumatically (including by vacuum), or a combination thereof. Preferably, the means for rotating the rotating member are designed to withstand temperature, hazards, and other operating conditions expected at the wellhead.

Figure 7:
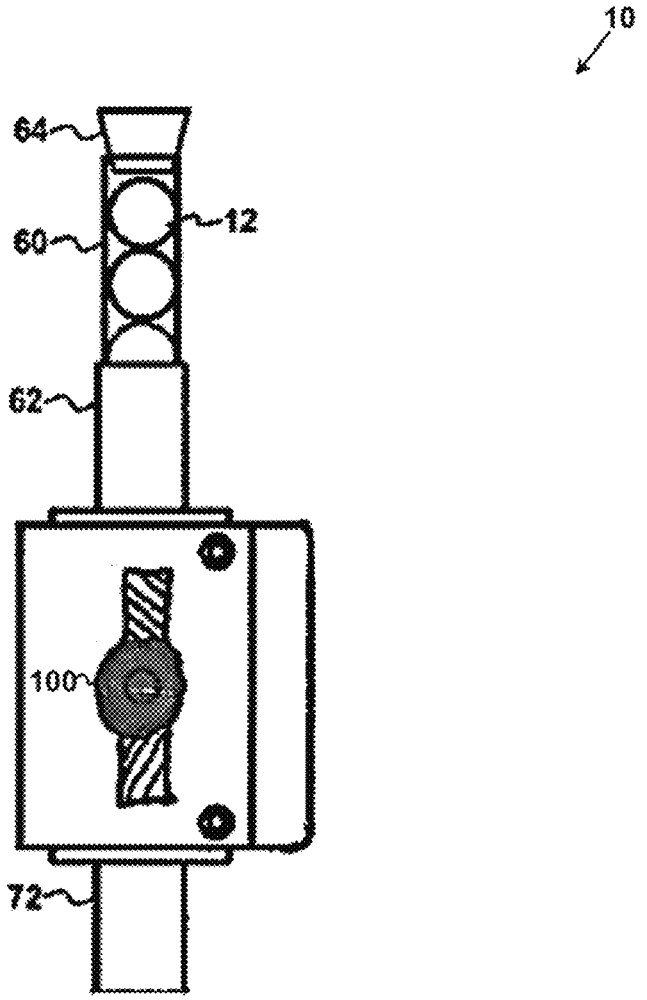
FIG. 7 shows a front elevation view of a third embodiment of the present invention, for dropping frac balls into a wellhead tubular, where the apparatus includes a hydraulic rotary actuator for rotating the rotating member.

Preferably, the means for rotating the rotating member (40) allows the operator to control rotation of the rotating member (40) at a location on the ground that is remotely located from the rotating member (40). Accordingly, the operator may be positioned at a safe distance from the operations surrounding the wellhead into which the frac ball (12) is being dropped. Non-limiting examples of means for rotating the rotating member may include one or a combination of the following: an electro-mechanical motor in driving engagement with the rotating member (40) via a belt or gear; a cable wound onto the rotating member (40) to rotate the rotating member (40) when tension is applied to the cable either directly by hand, or by a winch, which may be manually operated or motor driven; or any other type of rotary actuator that may be driven by mechanical, electrical, hydraulic, pneumatic or vacuum power. FIG. 7 shows another embodiment of the apparatus (10) that is similar to the embodiment shown in FIGS. 1 to 4, with analogous parts labelled with the same reference numbers. In this embodiment, the means for rotating the rotating member is in the form of a hydraulic rotary actuator (100) that includes a hydraulic motor for converting differential hydraulic pressure into a torque applied to a shaft attached to the rotating member (40).

Remote control of the means for rotating the rotating member may be effected by providing electrical, hydraulic, or pneumatic lines of suitable length, or by operatively connected wireless signal technology (e.g., infrared (IR) transmitters and receivers, or radio frequency (RF) transmitters or receivers). When using powered equipment, it will be appreciated that certain precautions may have to be taken to reduce the risk of spark ignition hazards near the wellsite.

Inlet Tube.

The inlet tube (60) holds a plurality of frac balls (12) in a position where they can pass, one at a time, into the recess (42) of the rotating member (40) when the rotating member (40) is in the loading orientation.

In the embodiment shown in the Figures, the inlet tube (60) is attached to parts (22*a*, 22*b*) of the stationary member (20) with a flanged coupling tube (62) in communication with the frac ball inlet (28). The inlet tube (60) is shown as being sized to hold five frac balls (12), but may be sized to holder a fewer number or a greater number of frac balls (12). As a non-limiting example, the inlet tube (60) may be sized to hold fifteen frac balls (12). Also, the inlet tube (60) is sized to present the frac balls (12) in, sequentially, in single file, to the frac ball inlet (28), and the recess (42) when the rotating member (40) is in the loading orientation. As a non-limiting example, if the apparatus (10) is used with frac balls (12) having a diameter of about 1.75 inches (about 44 mm), the inlet tube (60) may be sized to have a diameter substantially less than 3.5 inches (about 88 mm) (being less than twice the diameter of the frac balls (12)). Preferably, the inlet tube (60) is made of a transparent or translucent material (e.g., a transparent or translucent acrylic plastic) to allow the movement of the frac balls (12) towards the frac ball inlet (28) and the recess (42) of the rotating member (40) to be observed by an operator, or to be detected by an optical sensor that is external to the inlet tube (60). If the inlet tube (60) is not transparent or translucent, then the movement of the frac balls (12) may be monitored using other types of sensors, whether internal or external to the inlet tube (60). In this embodiment, a cap (64) is attachable to the upper end of the inlet tube (60) to prevent frac balls (12) from spilling out of the upper end of the inlet tube (60).

Outlet Tube.

The outlet tube (70) directs a frac ball (12), when dropped from the recess (42) of the rotating member (40), towards a desired location. The outlet tube (70) may not be required in embodiments of the invention where the frac ball (12) drops out of the recess (42) of the rotating member (40), towards a desired location, without the need for guidance.

In the embodiment shown in the Figures, the outlet tube (70) is attached to parts (22*a*, 22*b*) of the stationary member (20) with a flanged coupling tube (72) in communication with the frac ball outlet (30). In this embodiment, the outlet tube (70) directs the ball into the entry guide (18). In this embodiment, the frac ball outlet (30) is horizontally offset from the entry guide (18), and as such the outlet tube (70) is curved towards the entry guide (18). To accommodate this curvature, the outlet tube (70) may be made of a flexible material such as plastic or rubber. A strap (74) may be provided to secure the outlet tube (70) to the lubricator (16). Preferably, the outlet tube (70) is made of a transparent or translucent material (e.g., a transparent or translucent plastic) to allow the movement of the frac balls (12) from the frac ball outlet (30) towards the entry guide (18) to be observed by an operator, or to be detected by an optical sensor that is external to the outlet tube (70). If the inlet tube (70) is not transparent or translucent, then the movement of the frac balls (12) may be monitored using other types of sensors, whether internal or external to the outlet tube (70).

Use and Operation of Apparatus with Wellhead Assembly Having Entry Guide.

An exemplary use and operation of the embodiment of the apparatus (10) shown in FIGS. 1 to 4 for dropping frac balls into wellheads of well pad, is now described.

As known to persons skilled in the art of oil and gas well production pads, multiple oil and gas wells may be drilled in horizontally spaced locations on a single pad. The wells are positioned relatively close to each other at the surface. For example, the wellheads may be spaced at horizontal intervals of about intervals of about 4 meters (about 13 feet). As the wells are completed, wireline and hydraulic fracturing operations are performed in sequence repeatedly on each well in the pad. These operations may involve hazards, such as working around suspended loads, and may conflict with each other, such that one operation limits when and how the other operation can be performed. For instance, when hydraulic fracturing is underway on one well, for safety reasons operators may be excluded from an area radiating out from that well by a radius of about 15 m to 20 m (about 49 feet to 65 feet), which may impede wireline operations on an adjoining well. For another example, wireline operations require the use of suspended loads which present a work site hazard to operators when frac balls are dropped by hand into the well bore while standing in a basket beside a suspended load.

In an oil and gas well pad undergoing completions on multiple wells, it would be desirable to reduce the work site hazards and conflicts between wireline and hydraulic fracturing operations by enabling the wireline operator to remotely drop frac balls into a well bore that may be within the exclusion zone around a neighboring well that is undergoing hydraulic fracturing, and further by reducing work site hazards for operators by keeping operators away from suspended loads such as the wireline lubricator when dropping frac balls. The apparatus (10) of the present invention may be operated by a human wireline operator situated outside of the exclusion zone and without the necessity of working beside a suspended load, so that a frac ball can be dropped into the wellhead while hydraulic fracturing operations are performed on a nearby wellhead.

Prior to use of the apparatus (10), a tubular adapter (not shown) is attached to, and extends upwardly from a Christmas tree of a wellhead assembly of a well pad. The entry guide (18) extends upwardly and radiates outwardly from the upper end of the tubular adapter. While the lubricator (16) is on the ground, the top end of the test pin sub (14) is attached to the bottom end of the lubricator (16) by a threaded connection to form a pipe. To install the apparatus (10), the stationary member (20) is attached to the lubricator (16) at about 3 to 4 feet (about 0.9 to 1.2 m) above the bottom end of the lubricator (16) while the lubricator (16) is still on the ground beside the well head. The outlet tube (70) is connected to the bottom flanged coupling tube (72), and secured to the lubricator (16) by the strap (74), just above the test pin sub (14). If necessary, the outlet tube (70) is cut to length so that its bottom end will terminate inside the entry guide (18) when the test pin sub (14) is connected to the tubular adapter of the wellhead assembly. The hydraulic fluid lines (56*a*, 56*b*) are connected to the hydraulic pump (58). The hydraulic fluid lines (56*a*, 56*b*) should be of length such that the hydraulic pump (58) can be positioned on the ground outside the exclusion zone of any well on the pad then undergoing hydraulic fracturing. Preferably, the hydraulic fluid lines (56*a*, 56*b*) are color-coded with labels (e.g., colored zip ties) to ensure that the appropriate line is connected to the appropriate port of the hydraulic pump (58). A wireline tool string is inserted into the lubricator (16). A crane is used to lift the assembly of the lubricator (16), the wireline tool string, the attached test pin sub (14), the stationary member (20), the inlet tube (60) and the outlet tube (70), from the ground and into a vertical orientation, while the hydraulic pump (58) remains on the ground. The inlet tube (60) is then loaded with a desired number of frac balls (12), and the cap (64) is secured to the top of the inlet tube (60). After this step, the crane lifts the lubricator (16), with the apparatus (10) attached, above the entry guide (18), while the hydraulic pump (58) remains on the ground. The lubricator (16) is releasably connected in a pressure tight manner onto the wellhead via the test pin sub (14) and the tubular adapter, and the wireline operation begins. After the wireline operation has been completed, the wireline tool is withdrawn, and the well is ready to receive the frac ball (12). To prepare the apparatus (10) for use, the hydraulic pump (58) is used to actuate the rotating member (40) into the loading orientation as shown in FIG. 1. The operator may visually confirm that the rotating member (40) is in the loading position by observing that the piston rod (54) and/or the toothed rack (50) are at the bottom end of their travel. Since the rotating member (40) is in the loading orientation, the lowest one of the frac balls (12) will drop from the inlet tube (60) through the frac ball inlet (28) into the aligned recess (42) of the rotating member (40).

To drop the frac ball (12) into the Christmas tree, the operator switches the hydraulic pump (58) to the "release mode" to create a net upward fluid pressure on the piston rod (54). The operator actuates the hand lever of the hydraulic pump (58), repeatedly as necessary, to move the piston rod (54) and the attached toothed rack (50) upwards in relation to the rotating member (40), thereby driving counter-clockwise rotation (as viewed in FIG. 1) of the rotating member (40) by 180 degrees to the releasing orientation. As the rotating member (40) rotates, the frac ball (12) received in the recess (42) moves in unison through the race along an arcuate path. Upon reaching the releasing orientation, the frac ball (12) drops out of the recess (42), through the aligned frac ball outlet (30) and into the outlet tube (70). The outlet tube (70) directs the frac ball (12) into the entry guide (18). The operator may visually confirm that the frac ball (12) has been released into the entry guide (18) by observing the frac ball (12) as it drops through the transparent or translucent outlet tube (70). The test pin sub (14) is then removed from the entry guide (18), whereupon the frac ball (12) drops through the entry guide (18), down through the tubular adapter, and into the Christmas tree, from which position, after a sequence of opening and closing valves and equalizing pressure, it is transported into the well bore tubular where it is pumped down into the well as part of hydraulic fracturing operations.

The lubricator assembly (i.e., the lubricator (16) along with the test pin sub (14)) to which the apparatus (10) is attached is then removed from the well and prepared for the next wireline operation on the next well with the apparatus (10) still attached. After the lubricator (16) and wireline tool string is prepared, they are again connected onto the next well and the wireline operation is repeated. After it has been performed, to prepare the apparatus (10) for releasing another frac ball (12), the operator switches the hydraulic pump (58) to the "loading mode" to create a net downward fluid pressure on the piston rod (54). The operator actuates the hand lever of the hydraulic pump (58), repeatedly as necessary, to move the piston rod (54) and the attached toothed rack (50) downwards in relation to the rotating member (40), thereby driving clockwise rotation (as viewed in FIG. 1) of the rotating member (40) by 180 degrees towards the loading orientation. Upon reaching the loading orientation, the bottommost frac ball (12) remaining in the inlet tube (60) drops through the frac ball outlet (30) and into the aligned recess (42). The operator may visually confirm that this frac ball (12) has dropped into the recess (42) by observing movement of the frac balls (12) through the transparent or translucent inlet tube (60). The process for releasing the frac ball (12) into the Christmas tree as described above is then repeated when it is desired to drop the next frac ball into the next wellhead. The entire process is cycled from wellhead to wellhead on the pad. The apparatus (10) is reloaded with frac balls when required between cycles when the lubricator (16) is off the wellhead and suspended vertically.

Use and Operation of Apparatus with Wellhead Assembly without Entry Guide.

The exemplary use and operation of the apparatus (10) shown in FIG. 6 for dropping frac balls into a wellhead is now described. In this embodiment, the apparatus (10) is secured to the wellhead tubular (80) using the wellhead mount (82), with the flanged coupling tube (72) positioned over the wellhead tubular (70). An outlet tube (70) (not shown) may similarly be attached to the flanged coupling tube (72) to guide frac balls (12) into the wellhead tubular. When so installed, a hydraulic pump (58) (not shown) may be attached to the apparatus (as shown in FIG. 1) and used to actuate rotation of the rotating member (40), and thereby drop frac balls (12), one at a time, into the wellhead tubular (80).

Interpretation.

Any term or expression not expressly defined herein shall have its commonly accepted definition understood by a person skilled in the art.

The corresponding structures, materials, acts, and equivalents of all means or steps plus function elements in the claims appended to this specification are intended to include any structure, material, or act for performing the function in combination with other claimed elements as specifically claimed.

References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded.

It is further noted that the claims may be drafted to exclude any optional element. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention.

The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage.

The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc.

As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

The invention claimed is:

1. An apparatus for dropping frac balls into a wellhead tubular, the apparatus comprising:

(a) a stationary member;

(b) a rotating member defining a recess shaped and sized to receive a single one of the frac balls, wherein the rotating member is rotatably attached to the stationary member to rotate between a loading orientation in which the recess receives the single of the frac balls, and a releasing orientation in which the recess is oriented to allow the single one of the frac balls to drop out of the recess; and (c) a means for rotating the member between the loading orientation and the releasing orientation, comprising a toothed rack in driving engagement with a toothed gear defined by the rotating member, wherein at least part of the toothed rack is not concealed by any other part of the apparatus, such that a change in position of the toothed rack relative to the stationary member is visible to an operator of the apparatus.

2. The apparatus of claim 1, wherein in the loading orientation, the recess is oriented to allow the single one of the frac balls to drop into the recess by gravity feed.

3. The apparatus of claim 1, wherein the means for rotating the rotating member further comprises a hydraulic cylinder comprising a piston rod attached to the toothed gear, and a hydraulic pump for actuating the piston rod.

4. The apparatus of claim 3, wherein the hydraulic pump is connected to the hydraulic cylinder by a hydraulic fluid line having a length of at least 49 feet.

5. The apparatus of claim 1, wherein the stationary member comprises a plurality of parts removably attachable to each other to grip a pipe for forming a continuous path with the wellhead tubular.

6. The apparatus of claim 1, wherein the apparatus further comprises a support member attached to the stationary member and comprising a clamp for securing the support member to the wellhead tubular.

7. The apparatus of claim 1, wherein:

(a) the stationary member comprises a housing defining a frac ball inlet, and a frac ball outlet; and (b) the rotating member is disposed within the housing, and wherein:

(i) in the loading orientation, the recess is aligned with the frac ball inlet to allow the single one of the frac balls to pass through the frac ball inlet and into the recess; and (ii) in the releasing orientation, the recess is aligned with the frac ball outlet to allow the single one of the frac balls to drop out of the recess and through the frac ball outlet.

8. The apparatus of claim 7, wherein the housing defines an arcuate internal race that guides the single one of the frac balls from the frac ball inlet to the frac ball outlet, when the frac ball is received in the recess of the rotating member as the rotating member rotates between the loading orientation and the releasing orientation.

9. The apparatus of claim 1, wherein the apparatus further comprises an inlet tube for holding the frac balls and directing the frac balls to pass, one at a time, into the recess when the rotating member is in the loading orientation.

10. The apparatus of claim 9, wherein the inlet tube is transparent or translucent.

11. The apparatus of claim 1, wherein the apparatus further comprises an outlet tube for directing the single one of the frac balls that drops out of the recess.

12. The apparatus of claim 11, wherein the outlet tube is transparent or translucent.

13. A method of dropping frac balls into a wellhead tubular, the method comprising the steps of:

(a) providing an apparatus comprising a stationary member, and a rotating member defining a recess shaped and sized to receive a single one of the frac balls, wherein the rotating member is rotatably attached to the stationary member; and (b) rotating the rotating member, in relation to the stationary member, from a loading orientation and a releasing orientation, wherein:

(i) in the loading orientation, the recess receives the single one of the frac balls; and (ii) in the releasing orientation, the recess is oriented to drop the single one of the frac balls out of the recess;

wherein the step of rotating the rotating member comprises moving a toothed rack in driving engagement with a toothed gear defined by the rotating member, and wherein at least part of the toothed rack is not concealed by any other part of the apparatus, such that a change in position of the toothed rack relative to the stationary member is visible to an operator of the apparatus.

14. The method of claim 13, wherein in the loading orientation, the recess is oriented to allow the single one of the frac balls to drop into the recess by gravity feed.

15. The method of claim 13, wherein the step of moving the toothed rack comprises using a hydraulic pump to actuate a piston rod of a hydraulic cylinder attached to the toothed rack.

16. The method of claim 15, wherein the hydraulic pump is connected to the hydraulic cylinder by a hydraulic fluid line having a length of at least 49 feet.

17. The method of claim 13, wherein the method further comprises the step of attaching the stationary member to a pipe for forming a continuous tubular path with the wellhead tubular, by removably attaching to each other a plurality of parts forming the stationary member to grip the pipe.

18. The method of claim 13, wherein the method further comprises the step of attaching the stationary member to the wellhead tubular, by clamping a support member attached to the stationary member to the wellhead tubular.

19. The method of claim 13, wherein the rotating member is rotatably disposed in a housing defined by the stationary member, wherein the housing defines a frac ball inlet, and a frac ball outlet, wherein:

(a) in the loading orientation, the recess is aligned with the frac ball inlet to allow the single one of the frac balls to pass through the frac ball inlet and into the recess; and (b) in the releasing orientation, the recess is aligned with the frac ball outlet to allow the single one of the frac balls to drop out of the recess and through the frac ball outlet.

20. The method of claim 19, wherein the housing defines an arcuate internal race that guides the single one of the frac balls from the frac ball inlet to the frac ball outlet, when the frac ball is received in the recess of the rotating member as the rotating member rotates between the loading orientation and the releasing orientation.

21. The method of claim 13, wherein the method further comprises loading the frac balls into an inlet tube, wherein the recess receives the single one of the frac balls from the inlet tube when the rotating member is in the loading orientation.

22. The method of claim 21, wherein the inlet tube is transparent or translucent.

23. The method of claim 13, wherein the method further comprises the step of allowing the frac ball dropped by the recess when the rotating member is in the releasing orientation to drop into an outlet tube.

24. The method of claim 23, wherein the outlet tube guides the frac ball dropped by the recess towards an entry guide extending upwardly and radiating horizontally outwardly from an upper end of the wellhead tubular.

25. The method of claim 23, wherein the outlet tube is transparent or translucent.

* * * * *